US010066334B2

(12) United States Patent
Mora et al.

(10) Patent No.: US 10,066,334 B2
(45) Date of Patent: Sep. 4, 2018

(54) WASHING MACHINE APPLIANCE WITH A DOOR LOCK ASSEMBLY

(71) Applicant: Haier US Appliance Solutions, Inc., Wilmington, DE (US)

(72) Inventors: Adam Raymond Mora, La Grange, KY (US); Michael Wuttikorn Ekbundit, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 21 days.

(21) Appl. No.: 15/205,040

(22) Filed: Jul. 8, 2016

(65) Prior Publication Data

US 2018/0010284 A1 Jan. 11, 2018

(51) Int. Cl.

| | |
|---|---|
| ***D06F 37/28*** | (2006.01) |
| ***E05B 47/00*** | (2006.01) |
| ***E05D 13/00*** | (2006.01) |
| ***E05C 3/12*** | (2006.01) |

(52) U.S. Cl.

CPC ..... *D06F 37/28* (2013.01); *E05B 47/0004* (2013.01); *E05B 47/0012* (2013.01); *E05C 3/12* (2013.01); *E05B 2047/0016* (2013.01)

(58) Field of Classification Search

CPC .. D06F 37/28; E05B 47/0004; E05B 47/0012; E05B 2047/0016; E05C 3/12; E05D 13/12; E05Y 2900/312

See application file for complete search history.

(56) References Cited

U.S. PATENT DOCUMENTS

| | | | | | |
|---|---|---|---|---|---|
| 2,921,710 | A * | 1/1960 | Hutterer | D06F 37/28 | 220/213 |
| 3,716,122 | A * | 2/1973 | Baker | D06F 37/203 | 192/136 |
| 3,857,002 | A | 12/1974 | Lay et al. | | |
| 3,997,751 | A * | 12/1976 | McNally | D06F 37/203 | 192/136 |
| 4,479,371 | A * | 10/1984 | Fesmire | D06F 95/00 | 248/638 |
| 4,623,179 | A * | 11/1986 | Davis | D06F 37/42 | 292/201 |
| 4,991,312 | A * | 2/1991 | Pambianchi | D06F 43/00 | 34/534 |
| 5,001,910 | A * | 3/1991 | Harmelink | D06F 37/42 | 200/61.62 |
| 5,038,587 | A * | 8/1991 | Harmelink | D06F 37/42 | 292/DIG. 69 |

(Continued)

FOREIGN PATENT DOCUMENTS

EP 1619288 B1 10/2009

*Primary Examiner* — Michael E Barr
*Assistant Examiner* — Benjamin L Osterhout
(74) *Attorney, Agent, or Firm* — Dority & Manning P.A.

(57) ABSTRACT

A vertical axis washing machine appliance includes a door pivotably mounted to a cabinet. The door includes a frame, an axle and a lever arm. The axle is fixed to the frame, and the lever arm is fixed to the axle. A door lock assembly is operable to lock the door in a closed position. The door lock assembly includes a latch and an actuator that is operable to move the latch between an engaged position and a disengaged position. The latch is engaged with the lever arm of the door when the latch is in the engaged position.

19 Claims, 10 Drawing Sheets

(56) References Cited

U.S. PATENT DOCUMENTS

| | | | | |
|---|---|---|---|---|
| 5,469,593 | A * | 11/1995 | Cuthbert | D06F 37/28 68/140 |
| 6,036,241 | A * | 3/2000 | Ostdiek | D06F 37/42 292/199 |
| 6,233,981 | B1 * | 5/2001 | Grandpierre | D06F 37/10 68/140 |
| 6,282,927 | B1 | 9/2001 | Wunderlich et al. | |
| 6,343,492 | B1 * | 2/2002 | Seagar | D06F 37/10 68/139 |
| 2001/0024039 | A1 * | 9/2001 | Lippoldt | B04B 7/06 292/197 |
| 2002/0073752 | A1 * | 6/2002 | Dirnberger | A47L 15/4259 70/266 |
| 2004/0104580 | A1 * | 6/2004 | Spiessl | D06F 37/42 292/84 |
| 2011/0181053 | A1 * | 7/2011 | Marschner | B04B 7/06 292/195 |
| 2011/0309638 | A1 * | 12/2011 | Gaj | A47L 15/4259 292/138 |
| 2016/0376742 | A1 * | 12/2016 | McDonald | D06F 37/42 8/137 |
| 2017/0058567 | A1 * | 3/2017 | Ivanovic | A47L 15/4259 |

* cited by examiner

WASHING MACHINE APPLIANCE WITH A DOOR LOCK ASSEMBLY

FIELD OF THE INVENTION

The present subject matter relates generally to washing machine appliance and door locks for the same.

BACKGROUND OF THE INVENTION

Washing machine appliances generally include a tub with a drum rotatably mounted therein. The drum defines a wash chamber for receipt of articles for washing. During operation of such washing machine appliances, a wash liquid is directed into the tub and onto articles within the wash chamber of the drum. The drum can rotate at various speeds to agitate articles within the wash chamber in the wash fluid, wring wash fluid from articles within the wash chamber, etc.

During operation, the drum can rotate at high angular velocities. A door of the washing machine appliance is preferably locked in a closed position when the drum is rotating at high angular velocities. With the door locked shut, a user may be prevented from accessing or reaching into the wash chamber. Locking mechanisms are frequently bulky and consume valuable space within the washing machine appliance, in particular areas below the door that a user frequently sees and where other components may be conveniently positioned.

Accordingly, a washing machine appliance with features for locking a door of the washing machine appliance in a closed position would be useful. In particular, a washing machine appliance with a lock that is conveniently positioned within the washing machine appliance would be useful.

BRIEF DESCRIPTION OF THE INVENTION

The present subject matter provides a vertical axis washing machine appliance that includes a door pivotably mounted to a cabinet. The door includes a frame, an axle and a lever arm. The axle is fixed to the frame, and the lever arm is fixed to the axle. A door lock assembly is operable to lock the door in a closed position. The door lock assembly includes a latch and an actuator that is operable to move the latch between an engaged position and a disengaged position. The latch is engaged with the lever arm of the door when the latch is in the engaged position. Additional aspects and advantages of the invention will be set forth in part in the following description, or may be apparent from the description, or may be learned through practice of the invention.

In a first exemplary embodiment, a vertical axis washing machine appliance is provided. The vertical axis washing machine appliance includes a cabinet having a top panel that defines an opening. A wash basket is positioned within the cabinet below the opening of the top panel. A door is pivotably mounted to the cabinet at the opening of the top panel such that the door is positioned over the opening of the top panel when the door is in a closed position. The door includes a frame, an axle and a lever arm. The axle is fixed to the frame at a rear portion of the frame. The lever arm is fixed to the axle such that the lever arm rotates with the axle. The lever arm extends away from the axle to a distal end portion. A door lock assembly is operable to lock the door in the closed position. The door lock assembly includes a latch positioned proximate the distal end portion of the lever arm when the door is in the closed position. An actuator is coupled to the latch. The actuator is operable to move the latch between an engaged position and a disengaged position. The latch is engaged with the lever arm of the door when the latch is in the engaged position such that the latch blocks movement of the door from the closed position. The latch is removed from the lever arm of the door when the latch is in the disengaged position such that the latch does not block movement of the door from the closed position.

In a second exemplary embodiment, a vertical axis washing machine appliance defines a vertical direction, a lateral direction and a transverse direction that are mutually perpendicular. The vertical axis washing machine appliance includes a cabinet having a top panel that defines an opening. The top panel extends between a front portion and a rear portion along the transverse direction. A wash basket is positioned within the cabinet below the opening of the top panel along the vertical direction. A door is pivotably mounted to the cabinet at the opening of the top panel. The door is adjustable relative to the top panel between an open position and closed position. The door includes a frame, an axle and a lever arm. The axle is positioned at the rear portion of the top panel and extends from the frame along the lateral direction. The frame is pivotable on the axle between the open and closed positions. The lever arm is fixed to the axle such that the lever arm rotates with the axle. The lever arm extends away from the axle to a distal end portion. A door lock assembly is positioned below the top panel along the vertical direction at the rear portion of the top panel. The door lock assembly is operable to lock the door in the closed position. The door lock assembly includes a latch positioned proximate the distal end portion of the lever arm when the door is in the closed position. An actuator is coupled to the latch. The actuator is operable to move the latch between an engaged position and a disengaged position. The latch is engaged with the lever arm of the door when the latch is in the engaged position such that the latch blocks movement of the door from the closed position. The latch is removed from the lever arm of the door when the latch is in the disengaged position such that the latch does not block movement of the door from the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
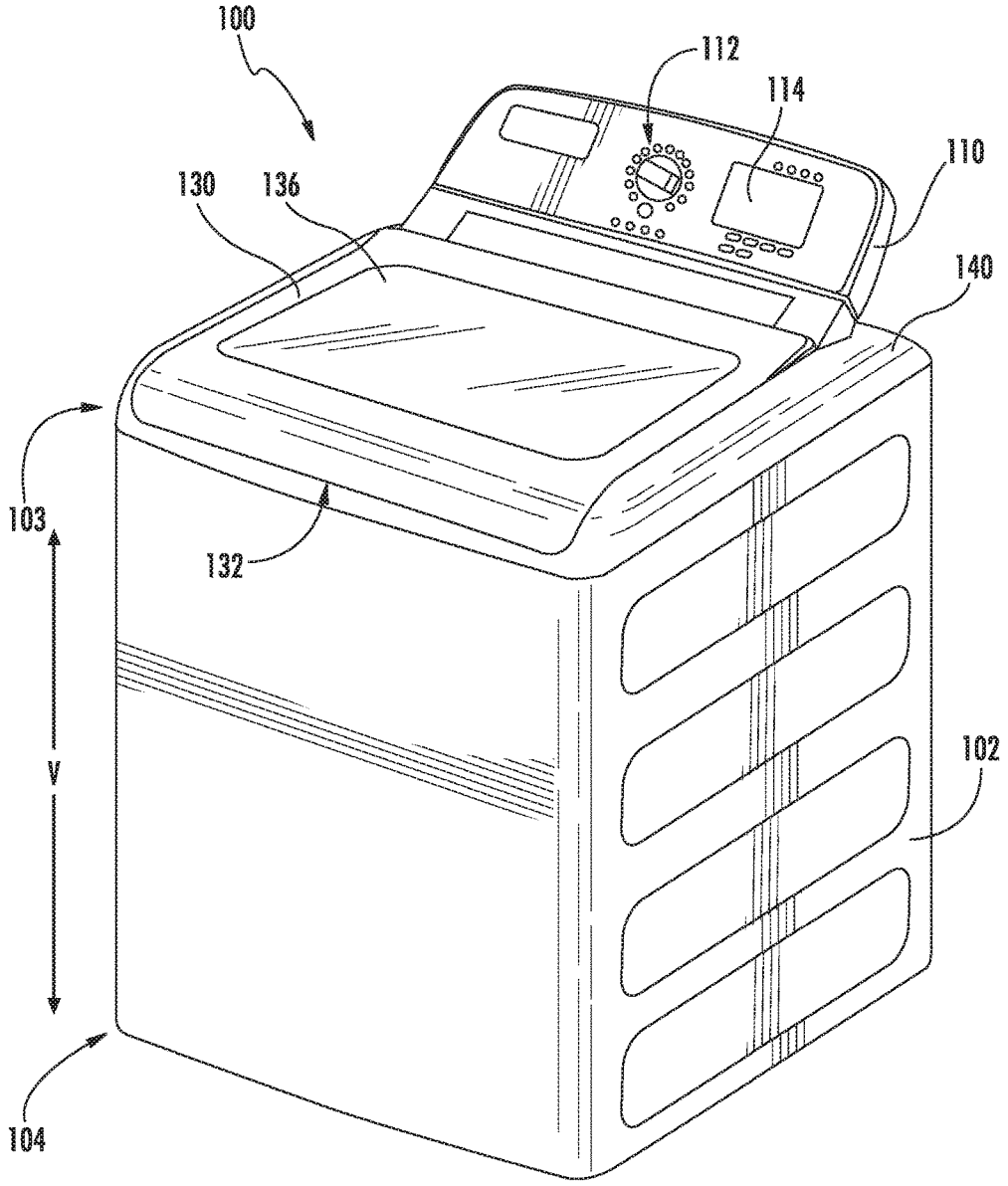
FIG. 1 provides a perspective view of a washing machine appliance according to an exemplary embodiment of the present subject matter with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
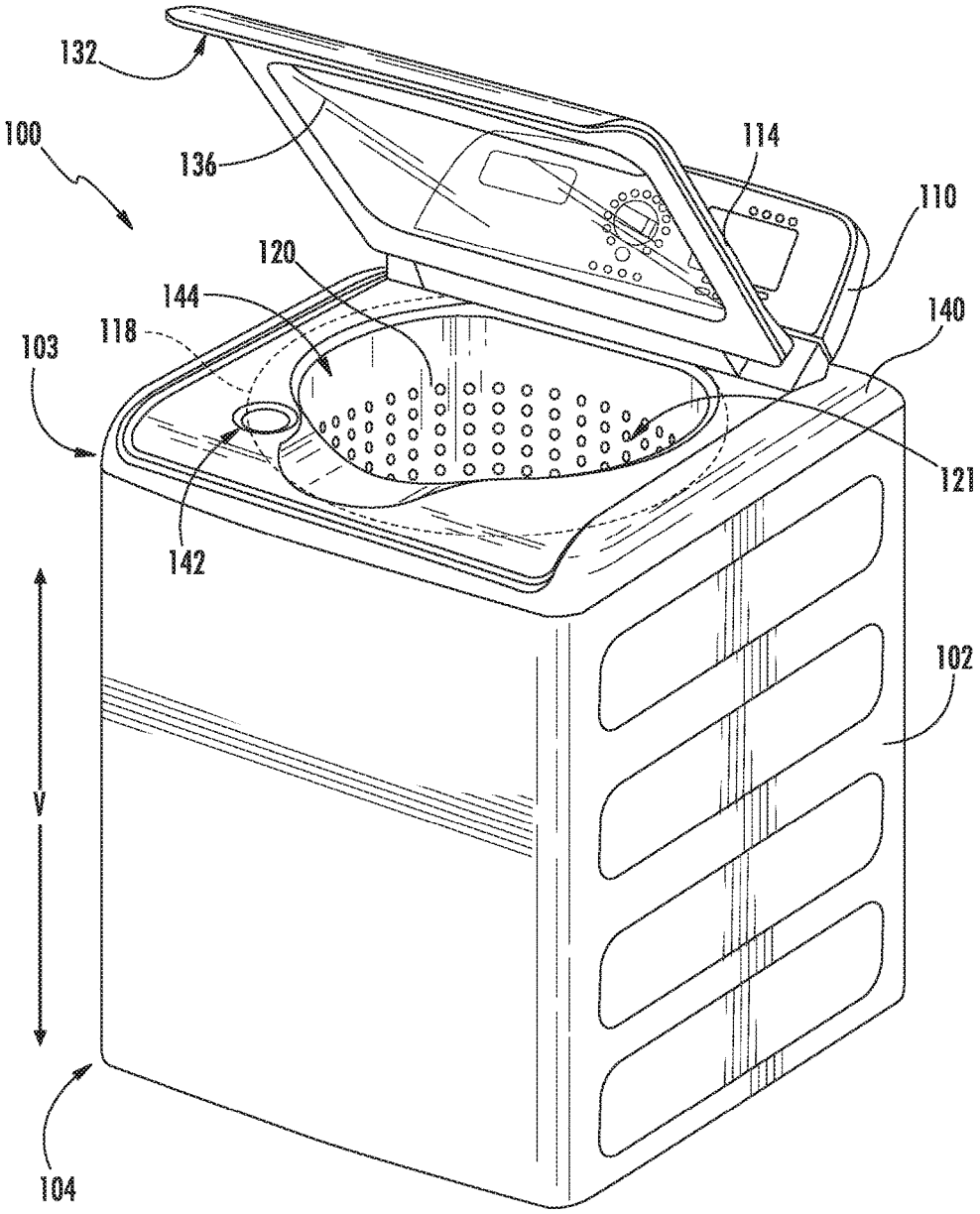
FIG. 2 provides a perspective view of the exemplary washing machine appliance of FIG. 1 with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. As discussed in greater detail below, washing machine appliance 100 includes features for locking door 130 in the closed position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along a vertical direction V. A wash basket 120 is rotatably mounted within cabinet 102, e.g., within a tub 118 positioned within cabinet 102. A motor (not shown) is in mechanical communication with wash basket 120 in order to selectively rotate wash basket 120 within tub 118, e.g., during an agitation or a rinse cycle of washing machine appliance 100. Wash basket 120 defines a wash chamber 121 that is configured for receipt of articles for washing. An agitator or impeller (not shown) extends from wash basket 120 into wash chamber 121. The impeller assists agitation of articles disposed within wash chamber 121 during operation of washing machine appliance 100, as will be understood by those skilled in the art.

Cabinet 102 of washing machine appliance 100 has a top cover or panel 140, e.g., at or adjacent top portion 103 of cabinet 102. Top cover 140 defines an aperture 144 that permits user access to wash chamber 121 of wash basket 120. Door 130 is rotatably or pivotally mounted to top cover 140. However, alternatively, door 130 may be mounted to cabinet 102 or any outer suitable support. Door 130 selectively rotates between the closed position shown in FIG. 1 and the open position shown in FIG. 2. In the closed position, door 130 is positioned over wash chamber 121 of wash basket 120 such that door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top cover 140 defines a hole or opening 142, e.g., at a corner of top cover 140 at or adjacent a front portion of top cover 140. Opening 142 is configured for receipt of one of a plurality of fluid additives, such as detergent, fabric softener or bleach. Opening 142 permits the fluid additive to pass through top cover 140 to portions of a receptacle (not shown) disposed below top cover 140 along the vertical direction V. Thus, a user may pour the fluid additives in to the receptacle through opening 142 in top cover 140.

A control panel 110 with a plurality of input selectors 112 extends from top cover 140. Control panel 110 and input selectors 112 collectively form a user interface input for operator selection of machine cycles and features. A display 114 of control panel 110 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items are loaded into wash chamber 121 through aperture 144, and washing operation is initiated through operator manipulation of input selectors 112. Wash basket 120 and/or tub 118 within cabinet 102 is filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated, e.g., with the impeller within wash basket 120, for cleansing of laundry items in wash basket 120.

After the agitation phase of the wash cycle is completed, wash basket 120 is drained. Laundry articles can then be rinsed by again adding fluid to wash basket 120, depending on the particulars of the cleaning cycle selected by a user, the impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 144.

As discussed above, wash basket 120 is rotatably mounted within tub 118 in cabinet 102. Wash basket 120 may be spaced apart from tub 118, e.g., by a radial gap, in order to permit rotation of wash basket 120 within tub 118. Tub 118 is configured for containing wash and rinse fluids during operation of washing machine appliance 100 described above. Wash and rinse fluids disposed within tub 118 can be used to clean articles disposed in wash basket 120. Wash and rinse fluids can pass between wash basket 120 and tub 118 through a plurality of perforations defined by wash basket 120, e.g., during the wash and/or spin cycles described above.

Washing machine appliance 100 also includes features for selectively securing door 130 in the closed position. Thus, during rotation of wash basket 120, door 130 may be locked shut in the closed position such that user access to wash basket 120 is limited or obstructed by door 130. Such features of washing machine appliance 100 are discussed in greater detail below in the context of FIGS. 3 through 10.

Figure 3:
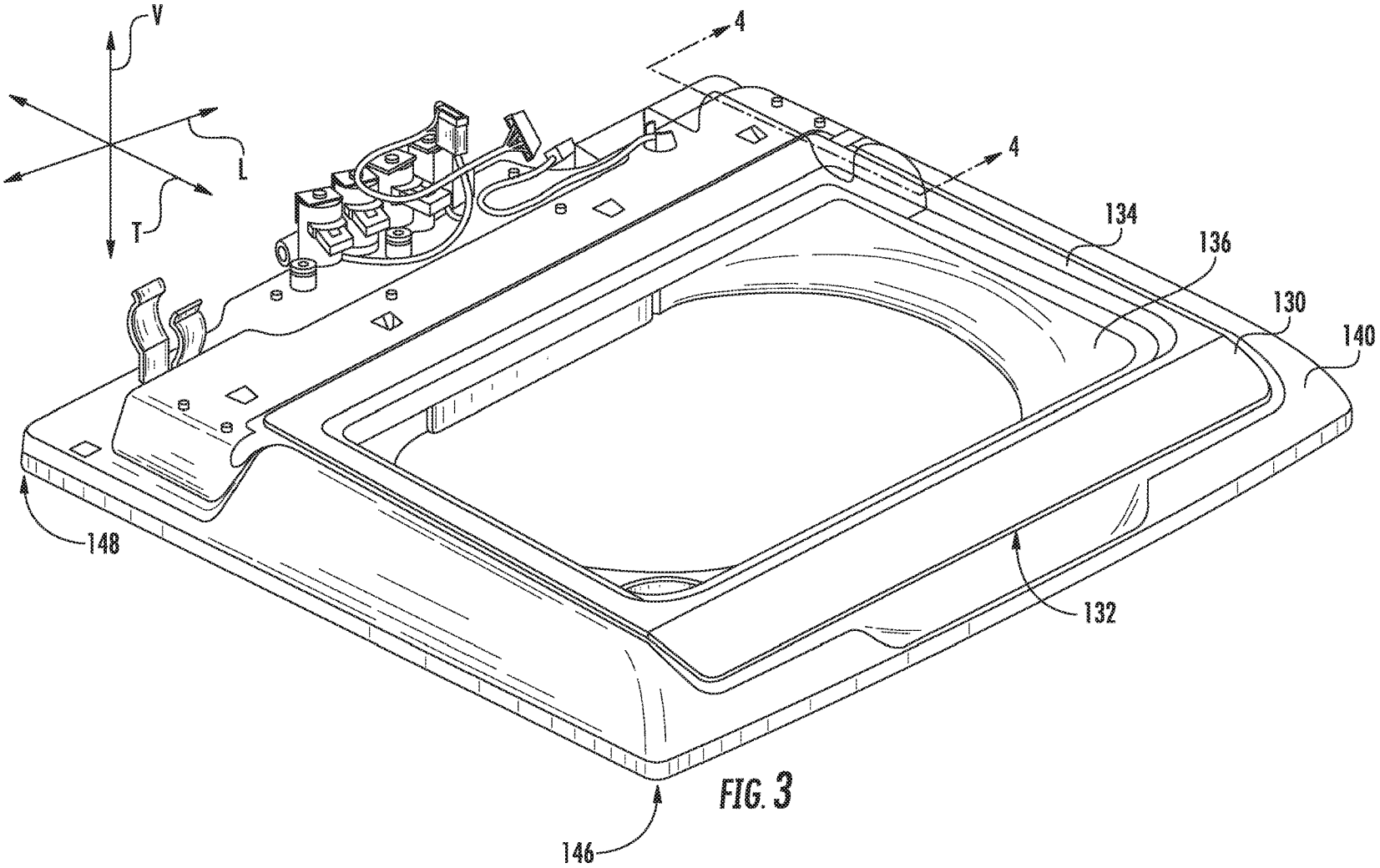
FIG. 3 provides a perspective view of a top panel and door of the exemplary washing machine appliance of FIG. 1.
Figure 4:
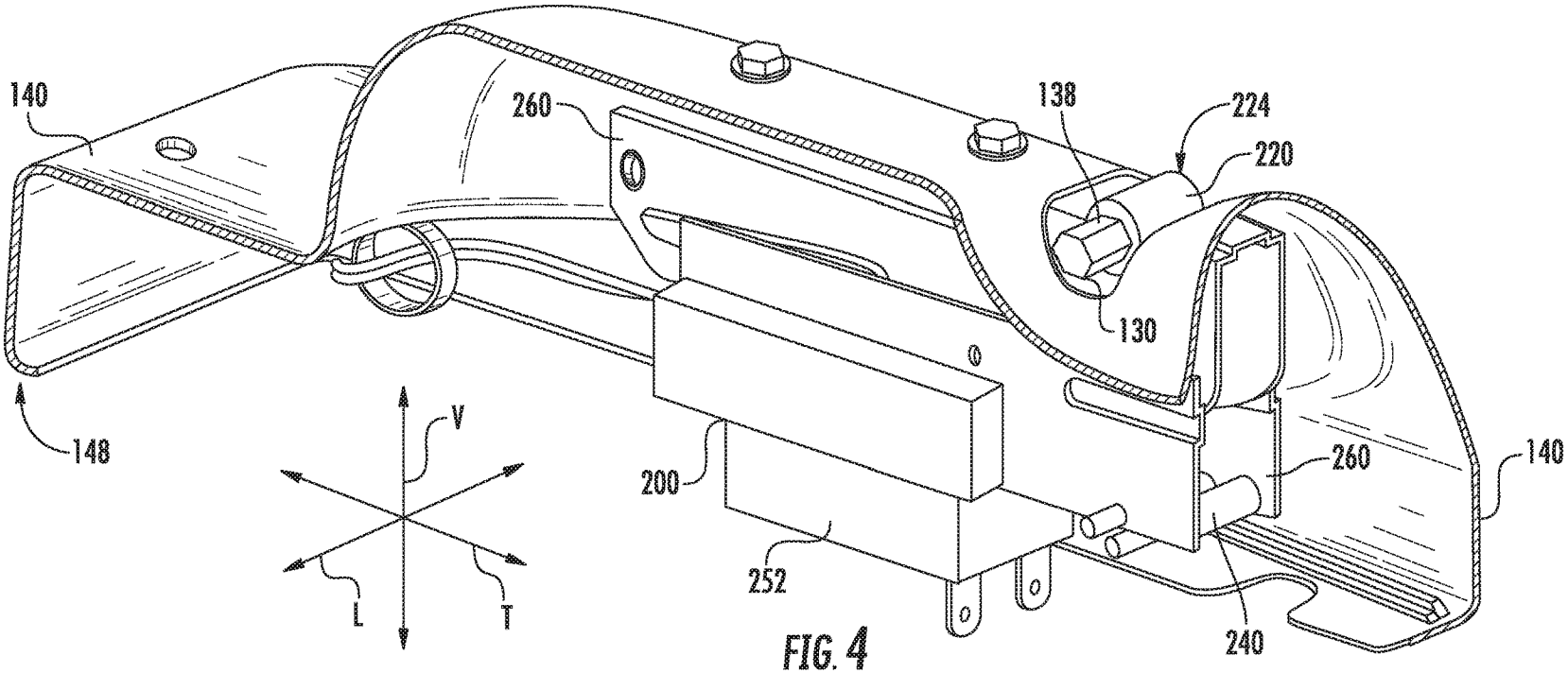
FIG. 4 provides a perspective, partial section view of the top panel and door of FIG. 3.

FIG. 3 provides a perspective view of top cover 140 and door 130 of washing machine appliance 100. FIG. 4 provides a perspective, partial section view of top cover 140 panel and a portion of door 130 taken along the 4-4 section line of FIG. 3. As may be seen in FIG. 3, top cover 140 defines a vertical direction V, a lateral direction L and a transverse direction T. The vertical direction V, lateral direction L and transverse direction T are mutually perpendicular and form an orthogonal direction system.

Top cover 140 extends between a front portion 146 and a rear portion 148, e.g., along the transverse direction T. Thus, front portion 146 and rear portion 148 or top cover 140 may be spaced apart from each other along the transverse direction T. Turning now to FIG. 4, washing machine appliance 100 includes a counterbalance and lock assembly 200 disposed below cover 140 along the vertical direction V. Counterbalance and lock assembly 200 may be positioned below cover 140 at or adjacent rear portion 148 of top cover 140. Counterbalance and lock assembly 200 assists with biasing or urging door 130 towards the open position. Thus, counterbalance and lock assembly 200 may assist a user with shifting door 130 from the closed positioned to the open position, e.g., by reducing the force required for the user to shift door 130 from the closed positioned to the open position. In addition, counterbalance and lock assembly 200 also includes features for locking door 130 in the closed position. By positioning counterbalance and lock assembly 200 at or adjacent rear portion 148 of top cover 140, valuable space below top cover 140 at or adjacent front portion 146 of top cover 140 may be utilized for other components of washing machine appliance 100, such as reservoirs for fluid additive, user input selectors, etc.

Figure 5:
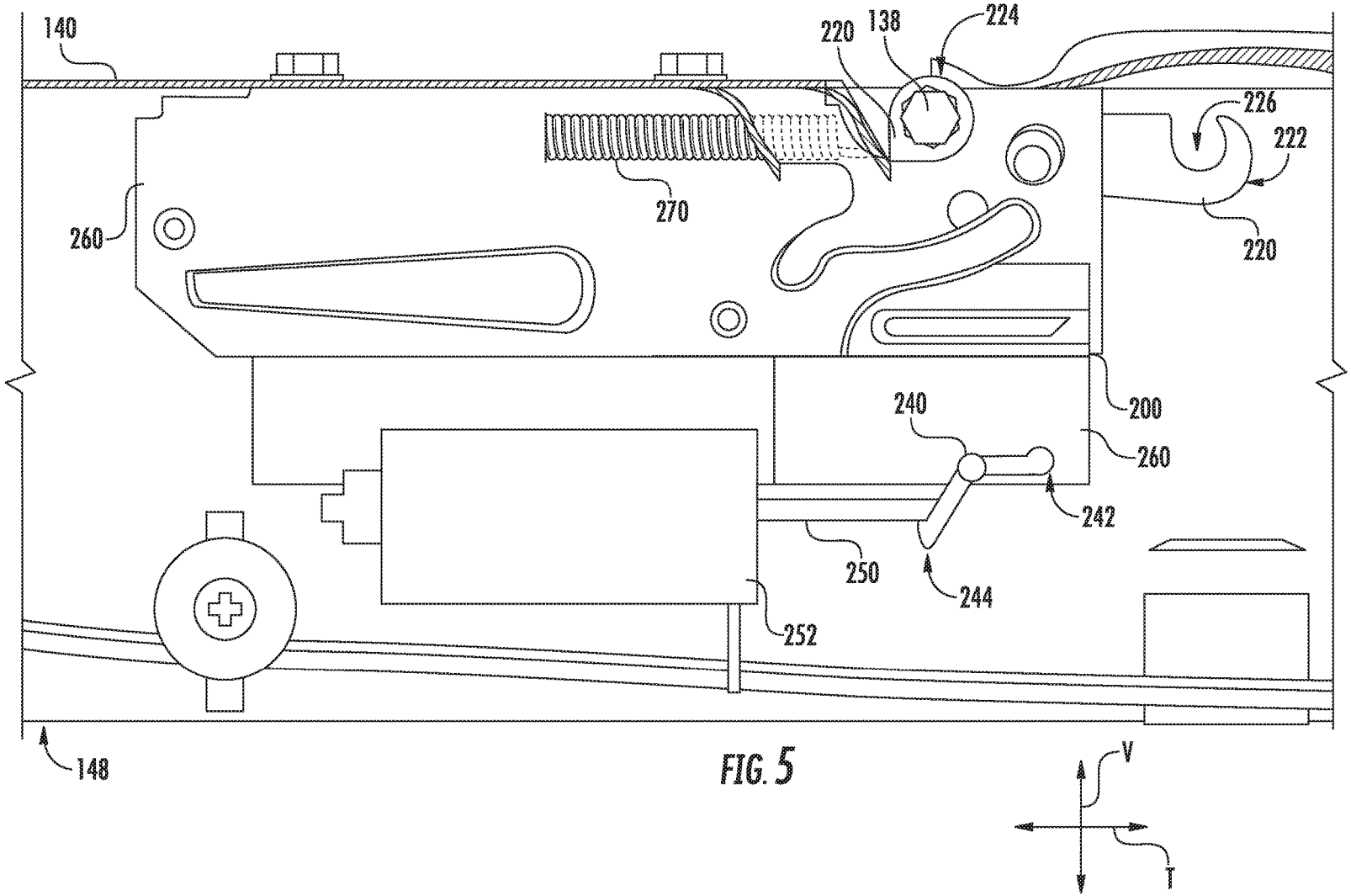
FIG. 5 provides a perspective, partial section view of the top panel and a door locking assembly of the exemplary washing machine appliance of FIG. 1 in a configuration corresponding to when the door is in the open position.
Figure 6:
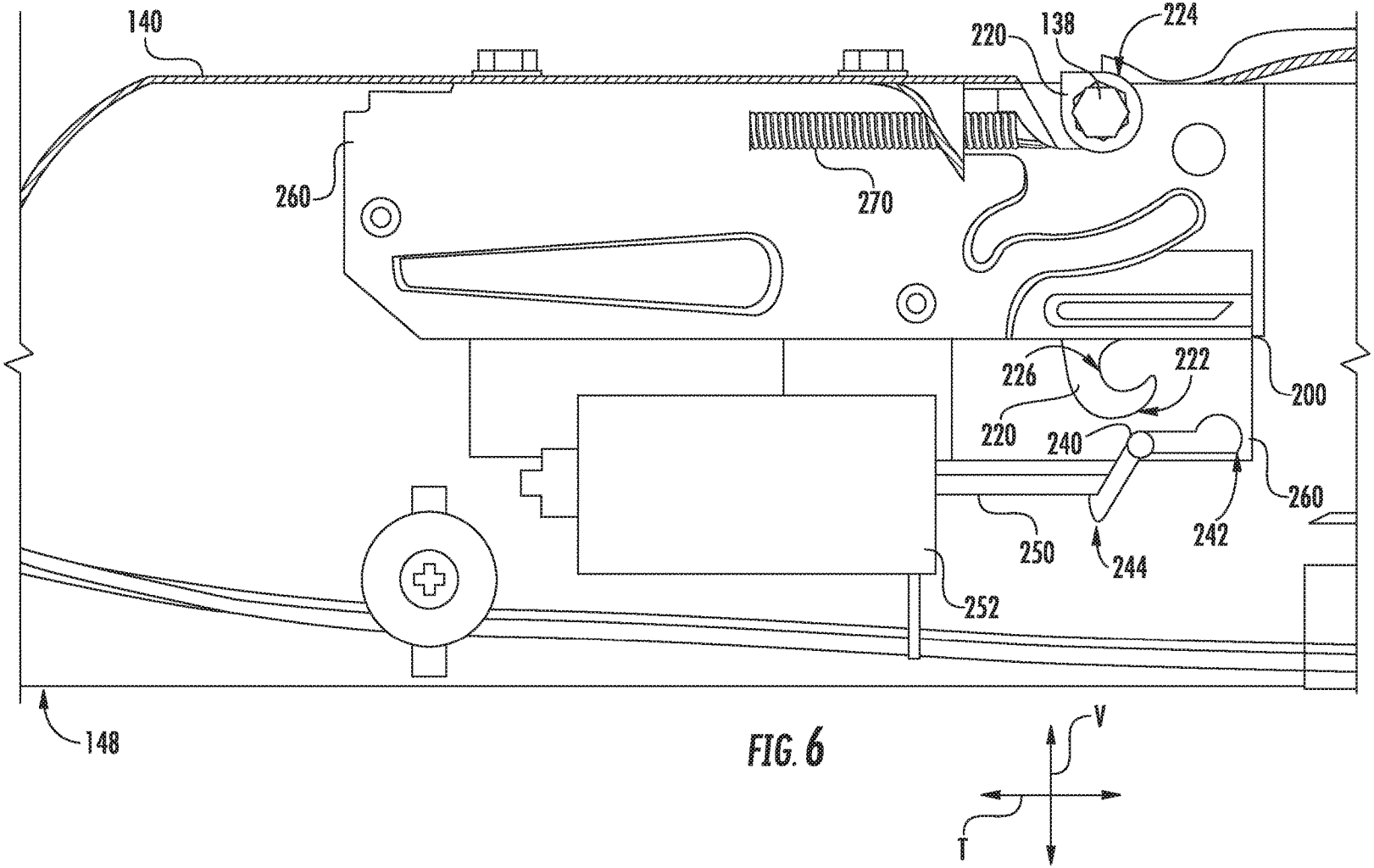
FIG. 6 provides a perspective, partial section view of the top panel and the door locking assembly of FIG. 5 in a configuration corresponding to when the door is in the closed position.
Figure 7:
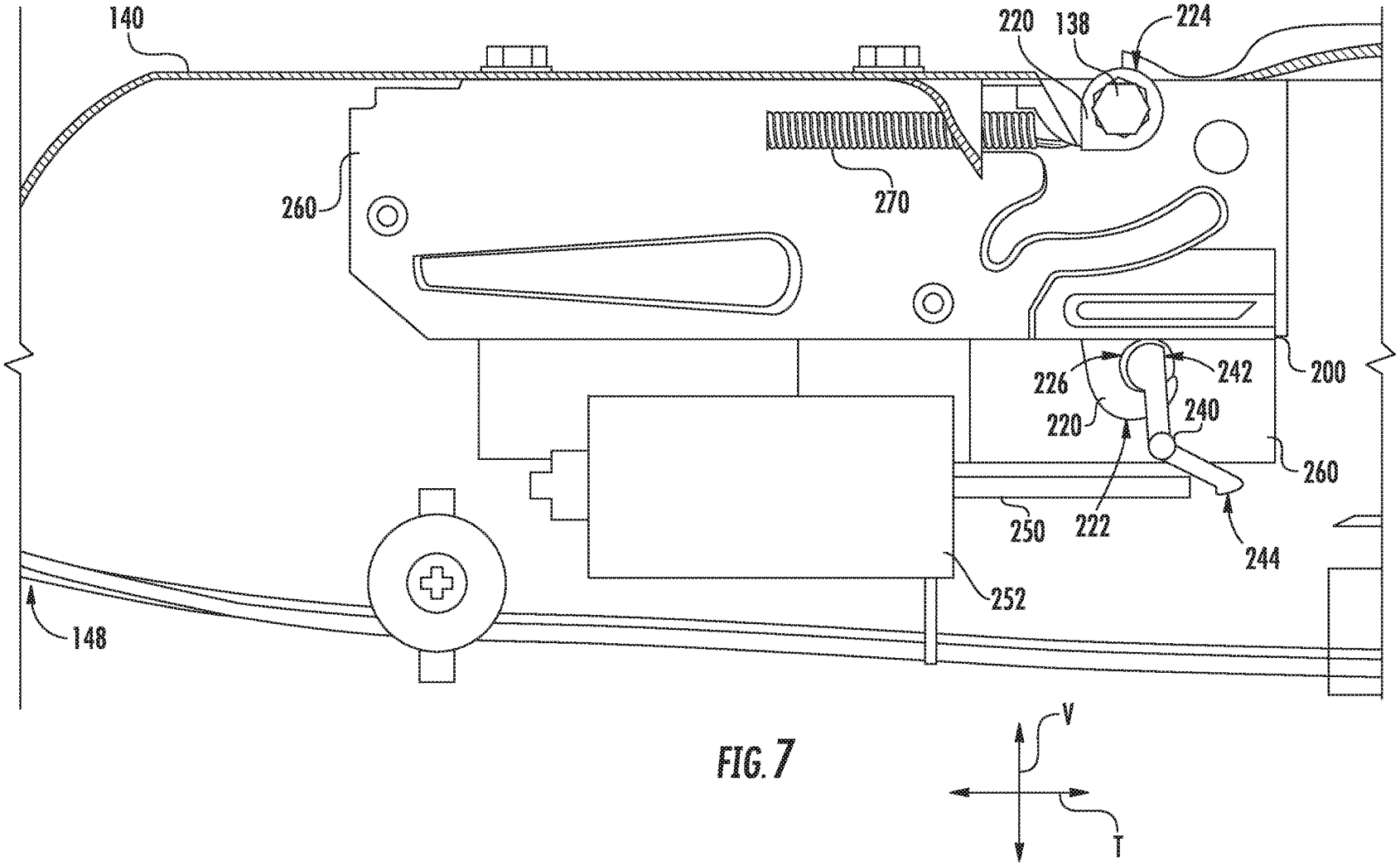
FIG. 7 provides a perspective, partial section view of the top panel and the door locking assembly of FIG. 6 in a configuration corresponding to when the door locking assembly locks the door is in the closed position.

FIGS. 5, 6 and 7 provide perspective, partial section views of top panel 140 and counterbalance and lock assembly 200. In FIG. 5, counterbalance and lock assembly 200 is shown in a configuration corresponding to when door 130 is the open position (FIG. 2) and a door locking assembly 230 is disengaged. In FIG. 6, counterbalance and lock assembly 200 is shown in a configuration corresponding to when door 130 is the closed position (FIG. 1) and door locking assembly 230 is disengaged such that door 130 is not locked in the closed position with door locking assembly 230. In FIG. 7, counterbalance and lock assembly 200 is shown in a configuration corresponding to when door 130 is the closed position and door locking assembly 230 is engaged such that door 130 is locked in the closed position with door locking assembly 230. Operation of door locking assembly 230 is discussed in greater detail below.

As may be seen in FIGS. 5, 6 and 7, door 130 includes an axle 138. Turning back to FIG. 3, door 130 also includes a frame 134, and window 136 may be mounted within frame 134 such that frame 134 extends around and/or bounds window 136. Axle 138 is fixed to frame 134, e.g., at a rear portion of frame 134 such that axle 138 and frame 134 are positioned at or adjacent rear portion 148 of top cover 140. Axle 138 rotates with frame 134 as door 130 shifts between the closed and open positions (FIGS. 1 and 2). In particular, frame 134 pivots or rotates on axle 138 relative to top cover 140 between the open and closed positions of door 130. Axle 138 may extend from frame 134 along the lateral direction L and may be received within and/or engage top cover 140 at or adjacent rear portion 148 of top cover 140. Thus, axle 138 assists with pivotally mounting door 130 on or to top cover 140.

Door 130 also includes a lever arm 220. Lever arm 220 is mounted to axle 138 and extends (e.g., radially) away from axle 138 to a distal end portion 222. Lever arm 220 is mounted to axle 138 such that lever arm 220 rotates with axle 138 as door 130 shifts between the closed and open positions. For example, a proximal end portion 224 of lever arm 220 may be received on axle 138, and an inner surface of lever arm 220 at proximal end portion 224 of lever arm 220 may be complementary to an outer surface of axle 138 such that torque is transmitted between axle 138 and lever arm 220 due to the meshing of axle 138 with lever arm 220.

Door locking assembly 230 includes a latch 240 and an actuator 250. Latch 240 is positioned proximate distal end portion 222 of lever arm 220 when door 130 is in the closed position, as shown in FIGS. 6 and 7. Latch 240 is engagable with lever arm 220 at distal end portion 222 of lever arm 220 in order to selectively lock door 130 in the closed position. Actuator 250 is coupled to latch 240. Actuator 250 is operable to move latch 240 between an engaged position (FIG. 7) and a disengaged position (FIG. 6). As may be seen in FIGS. 6 and 7, actuator 250 selectively engages latch 240 with lever arm 220 in order to lock door 130 in the closed position. In particular, latch 240 is engaged with lever arm 220 when actuator 250 positions latch 240 in the engaged position as shown in FIG. 7. Thus, latch 240 blocks movement of door 130 from the closed position when latch 240 in the engaged position. Conversely, latch 240 is removed from lever arm 220 when actuator 250 positions latch 240 in the disengaged position as shown in FIG. 6. Thus, latch 240 does not block movement of door 130 from the closed position when latch 240 in the disengaged position.

The controller of washing machine appliance 100 is in operative communication with actuator 250. Thus, the controller may operate actuator 250 to adjust latch 240 between the engaged and disengaged positions. For example, at the start of a wash cycle, the controller may operate actuator 250 to shift latch 240 from the disengaged position to the engaged position in order to lock door 130 in the closed position and limit user access to wash chamber 121 of wash basket 120, e.g., during the wash cycle. At the end of the wash cycle, the controller may operate actuator 250 to shift latch 240 from the engaged position to the disengaged position in order to unlock door 130 and allow user access to wash chamber 121 of wash basket 120. The controller may operate actuator 250 to shift latch 240 between the engaged and disengaged positions at any other suitable times in alternative exemplary embodiments.

Latch 240 and actuator 250 may be any suitable type combination of latch and actuator. For example, as shown in FIGS. 6 and 7, actuator 250 may be a linear actuator that moves a shaft along the transverse direction T to engage latch 240. Thus, actuator 250 may include an electric motor 252 that is mechanically connected to rotate a lead screw having a lead nut or ball nut thereon such that the lead nut or ball nut is driven by rotation of the lead screw by the electric motor 252. When actuator 250 is a linear actuator, door locking assembly 200 may include a bracket 260 mounted to cabinet 102, e.g., to top cover 140 in order to mount actuator 250 to top cover 140. As shown in FIGS. 6 and 7, latch 240 may extend between a first end portion 242 and a second end portion 244. Latch 240 may be pivotably mounted to bracket 260 between first and second end portions 242, 244 of latch 240. For example, an axle of latch 240 may be formed between first and second end portions 242, 244 of latch 240 and be received by bracket 260 in order to pivotably mount latch 240 to bracket 260. Actuator 250 may be coupled to latch 240 at second end portion 244 of latch 240. Conversely, first end portion 242 of latch 240 contacts or engages lever arm 220 when latch 240 is in the engaged position. For example, lever arm 220 may define a recess 226 at distal end portion 222 of the lever arm 220. First end portion 242 of latch 240 may be received within recess 226 of lever arm 220 when latch 240 is in the engaged position, and first end portion 242 of latch 240 may be removed from recess 226 of lever arm 220 when latch 240 is in the disengaged position. In such a manner, latch 240 may be pivotable on bracket 260 with actuator 250 between the engaged and disengaged positions.

In alternative exemplary embodiments, latch 240 may be rotatable between the engaged and disengaged configurations. For example, actuator 250 may be a motor that rotates latch 240 between the engaged and disengaged configurations. Thus, to reiterate, it should be understood that latch 240 and actuator 250 may be any suitable combination of latch and actuator where the actuator is coupled to the latch and operable to move the latch into and out of engagement with the lever arm 220 and thereby selectively lock door 130 in the closed position.

As discussed above, in addition to selectively locking door 130 in the closed position, counterbalance and lock assembly 200 includes features for biasing or urging door 130 towards the open position. In particular, counterbalance and lock assembly 200 includes a biasing mechanism 270 (shown in an exemplary manner as a coil spring). Biasing mechanism 270 is coupled to lever arm 220 and cabinet 102, e.g., top cover 140 via bracket 260. Biasing mechanism 270 applies a force to lever arm 220 that urges door 130 to rotate towards the open position (FIG. 2). For example, from the closed position (FIG. 1), a user may grasp door 130 at handle 132 and lift door 130 such that door 130 rotates towards the open position. Biasing mechanism 270 is coupled to door 130 such that biasing mechanism 270 reduces the force required by the user to lift door 130 and rotate door 130 towards the open position. Biasing mechanism 270 may be any suitable type of biasing mechanism. For example, biasing mechanism 270 may be a coil spring or a gas spring, e.g., that is coupled to door 130/lever arm 220 and cabinet 102 or other stationary component of washing machine appliance 100.

By positioning door locking assembly 230 and biasing mechanism 270 below top cover 140 at or adjacent rear portion 148 of top cover 140, valuable space below top cover 140 at or adjacent front portion 146 of top cover 140 is available for other components of washing machine appliance 100, such as reservoirs for fluid additive, user input selectors, etc. Thus, door 130 may be counterbalanced as well as selectively locked at or adjacent rear portion 148 of top cover 140 with counterbalance and lock assembly 200.

Figure 8:
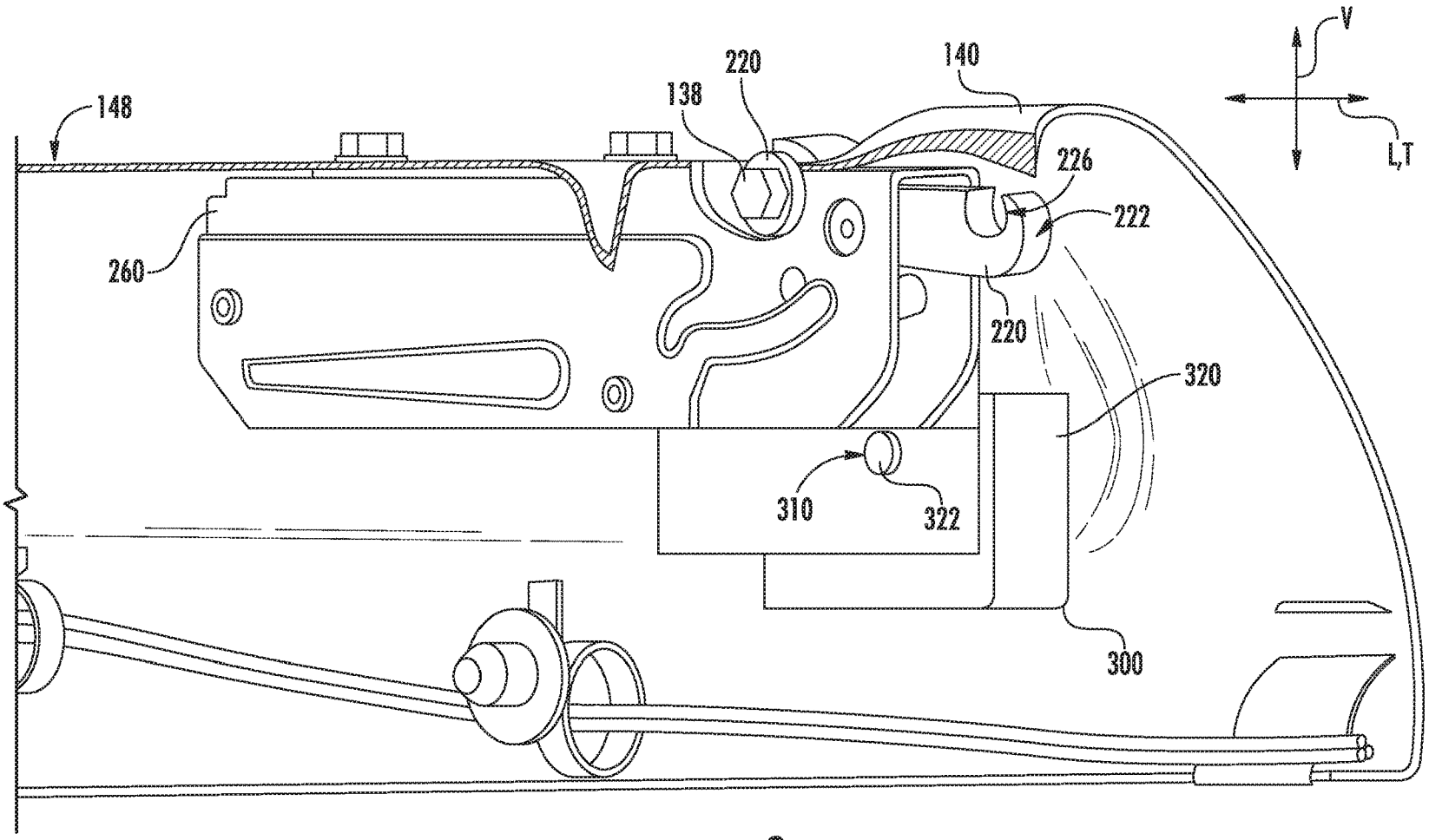
FIG. 8 provides a perspective, partial section view of a top panel and a door locking assembly according to another exemplary embodiment of the present subject matter in a configuration corresponding to when a door is in an open position.
Figure 9:
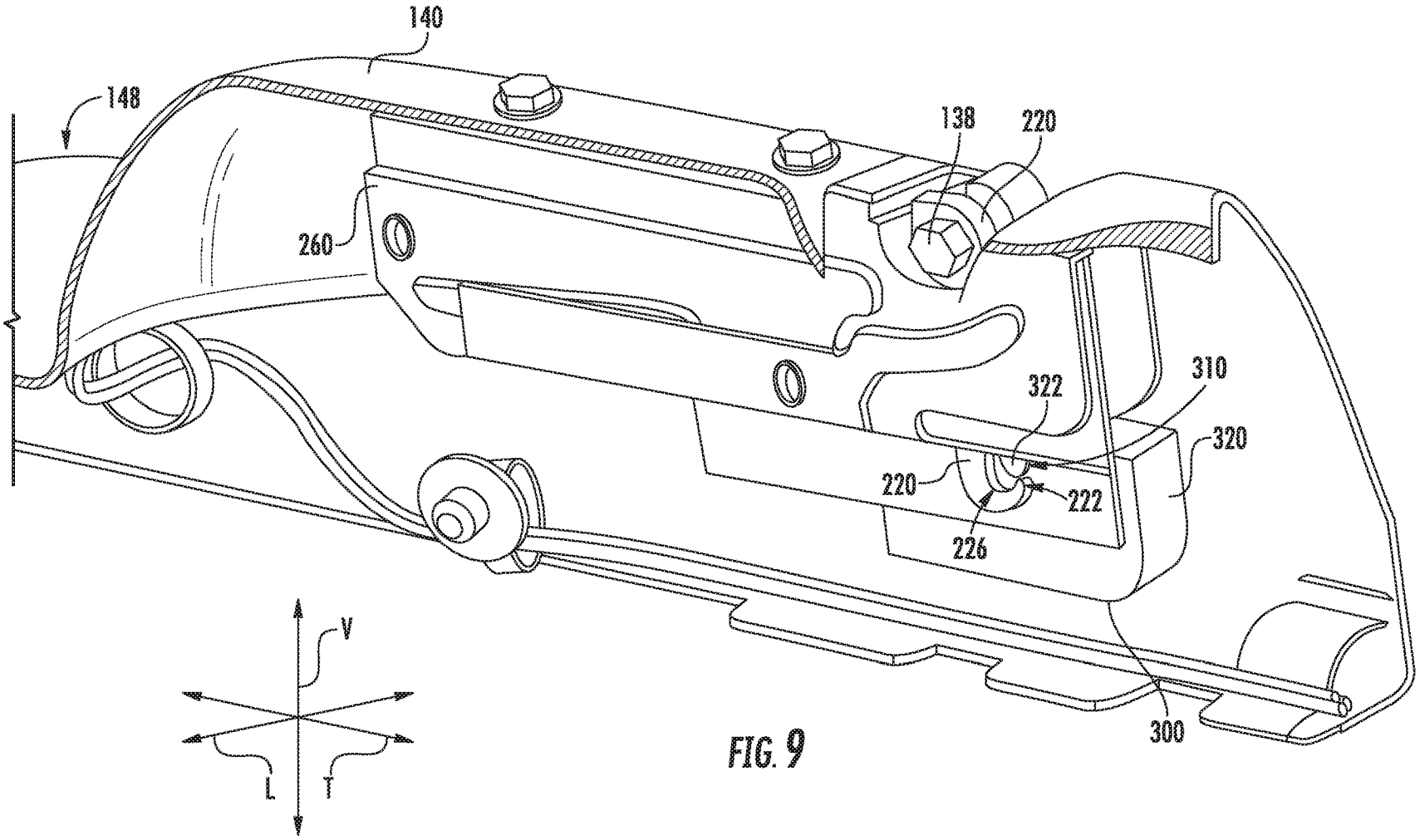
FIG. 9 provides a perspective, partial section view of the top panel and exemplary door locking assembly of FIG. 8 in a configuration corresponding to when the door is in a closed position.
Figure 10:
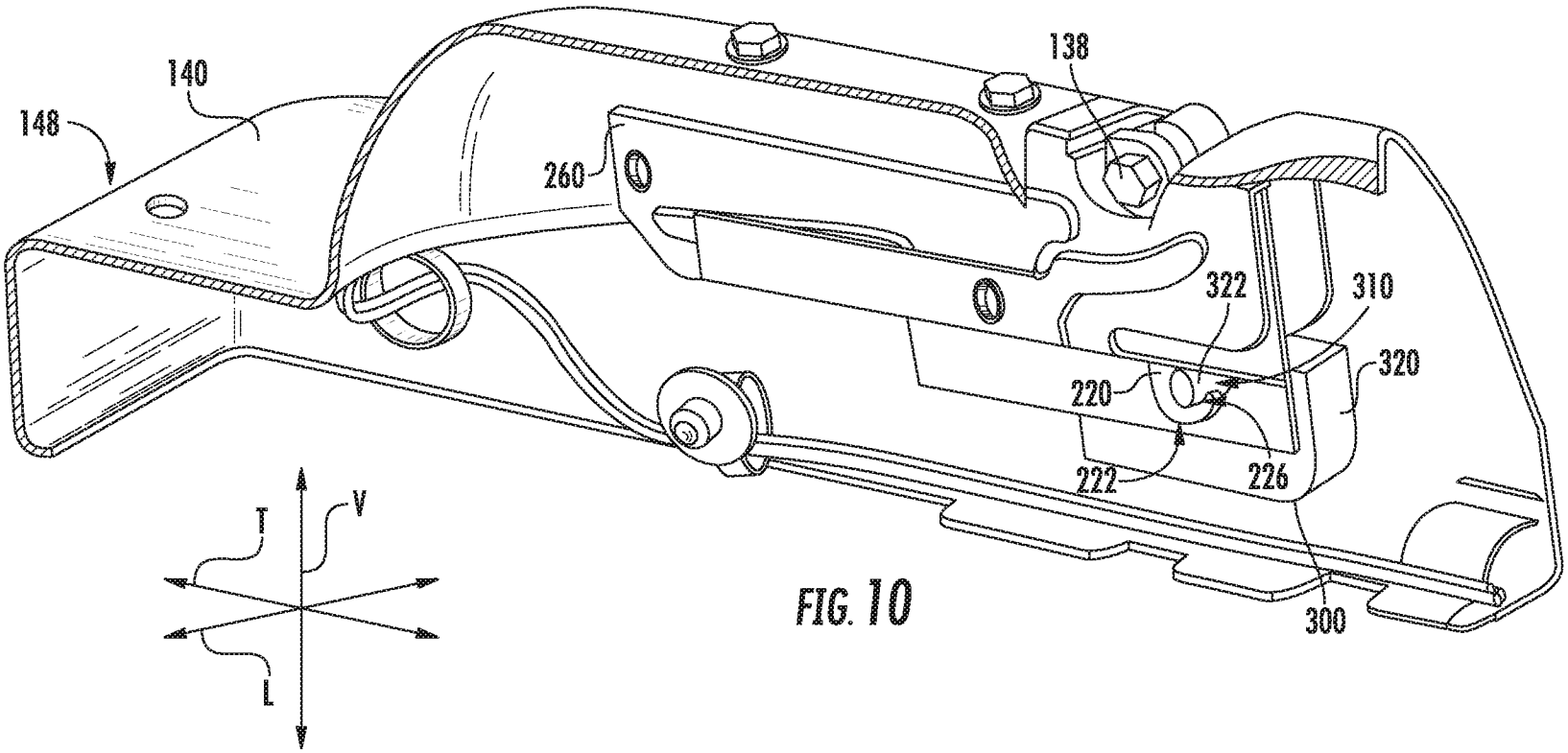
FIG. 10 provides a perspective, partial section view of the top panel and exemplary door locking assembly of FIG. 9 in a configuration corresponding to when the door locking assembly locks the door is in the closed position.

It should be understood that door locking assembly 230 is provided by way of example and is not intended to limit the present subject matter to the particular latch 240 and actuator 250 illustrated in FIGS. 4 through 7. Thus, e.g., a door locking assembly 300 according to an alternative exemplary embodiment of the present subject matter is provided in FIGS. 8 through 10. FIG. 8 provides a perspective, partial section view of top panel 140 and door locking assembly 300 in a configuration corresponding to when door 130 is in the open position. FIG. 9 provides a perspective, partial section view of top panel 140 and door locking assembly 300 in a configuration corresponding to when door 130 is in the closed position and door locking assembly 300 is disengaged such that door 130 is not locked in the closed position with door locking assembly 300. FIG. 10 provides a perspective, partial section view of top panel 140 and door locking assembly 300 in a configuration corresponding to when door locking assembly 300 is engaged and locks door 130 is in the closed position.

As shown in FIGS. 8 through 10, door locking assembly 300 includes a latch 310 and an actuator 320. Actuator 320 is an electromechanical solenoid. Latch 310 includes a shaft 322 that is coupled to actuator 320. Actuator 320 is operable to extend and retract shaft 322, e.g., along the lateral direction L. Thus, actuator 320 may selectively extend and retract shaft 322 in order to shift latch 310 between the engaged and disengaged positions. In the engaged position, shaft 322 may be received within recess 226 of lever arm 220. Conversely, shaft 322 may be removed from recess 226 of lever arm 220 when latch 310 is in the disengaged position. In such a manner, latch 310 may be linearly translatable with actuator 320 between the engaged and disengaged positions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A vertical axis washing machine appliance, comprising:

a cabinet having a top panel that defines an opening;

a wash basket positioned within the cabinet below the opening of the top panel;

a door pivotably mounted to the cabinet at the opening of the top panel such that the door is positioned over the opening of the top panel when the door is in a closed position, the door comprising a frame, an axle and a lever arm, the axle fixed to the frame at a rear portion of the frame, the lever arm fixed to the axle such that the lever arm rotates with the axle, a proximal end portion of the lever arm positioned on the axle, the lever arm extending radially away from the axle to a distal end portion; and a door lock assembly operable to lock the door in the closed position, the door lock assembly comprising a latch positioned proximate the distal end portion of the lever arm when the door is in the closed position; and an actuator coupled to the latch, the actuator operable to move the latch between an engaged position and a disengaged position, the latch engaged with the lever arm of the door when the latch is in the engaged position such that the latch blocks movement of the door from the closed position, the latch removed from the lever arm of the door when the latch is in the disengaged position such that the latch does not block movement of the door from the closed position.

2. The vertical axis washing machine appliance of claim 1, wherein the actuator is a linear actuator.

3. The vertical axis washing machine appliance of claim 2, wherein the door lock assembly further comprises a bracket mounted to the cabinet, the latch extending between a first end portion and a second end portion, the latch pivotably mounted to the bracket between the first and second end portions of the latch, the first end portion of the latch contacting the lever arm of the door when the latch is in the engaged position, the linear actuator coupled to the latch at the second end portion of the latch.

4. The vertical axis washing machine appliance of claim 3, the lever arm defines a recess at the distal end portion of the lever arm, the first end portion of the latch received within the recess of the lever arm when the latch is in the engaged position, the first end portion of the latch removed from the recess of the lever arm when the latch is in the disengaged position.

5. The vertical axis washing machine appliance of claim 1, wherein the actuator is an electromechanical solenoid.

6. The vertical axis washing machine appliance of claim 5, wherein the latch is a shaft coupled to the electromechanical solenoid, the electromechanical solenoid operable to extend and retract the shaft along a direction that is parallel to the axle of the door.

7. The vertical axis washing machine appliance of claim 6, the lever arm defines a recess at the distal end portion of the lever arm, the shaft received within the recess of the lever arm when the latch is in the engaged position, the shaft removed from the recess of the lever arm when the latch is in the disengaged position.

8. The vertical axis washing machine appliance of claim 1, further comprising a biasing mechanism coupled to the lever arm and the cabinet, the biasing mechanism applying a force to the lever arm that urges the door towards an open position.

9. The vertical axis washing machine appliance of claim 8, wherein the biasing mechanism is a coil spring or a gas spring.

10. The vertical axis washing machine appliance of claim 1, wherein the door lock assembly is positioned at a rear portion of the cabinet and below the top panel of the cabinet.

11. A vertical axis washing machine appliance defining a vertical direction, a lateral direction and a transverse direction that are mutually perpendicular, the vertical axis washing machine appliance comprising:

a cabinet having a top panel that defines an opening, the top panel extending between a front portion and a rear portion along the transverse direction;

a wash basket positioned within the cabinet below the opening of the top panel along the vertical direction;

a door pivotably mounted to the cabinet at the opening of the top panel, the door adjustable relative to the top panel between an open position and closed position, the door comprising a frame, an axle and a lever arm, the axle positioned at the rear portion of the top panel and extending from the frame along the lateral direction, the frame pivotable on the axle between the open and closed positions, the lever arm fixed to the axle such that the lever arm rotates with the axle, the lever arm extending radially from a proximal end portion on the axle to a distal end portion; and a door lock assembly positioned below the top panel along the vertical direction at the rear portion of the top panel, the door lock assembly operable to lock the door in the closed position, the door lock assembly comprising a latch positioned proximate the distal end portion of the lever arm when the door is in the closed position; and an actuator coupled to the latch, the actuator operable to move the latch between an engaged position and a disengaged position, the latch engaged with the lever arm of the door when the latch is in the engaged position such that the latch blocks movement of the door from the closed position, the latch removed from the lever arm of the door when the latch is in the disengaged position such that the latch does not block movement of the door from the closed position.

12. The vertical axis washing machine appliance of claim 11, wherein the actuator is a linear actuator.

13. The vertical axis washing machine appliance of claim 12, wherein the door lock assembly further comprises a bracket mounted to the cabinet, the latch extending between a first end portion and a second end portion, the latch pivotably mounted to the bracket between the first and second end portions of the latch, the first end portion of the latch contacting the lever arm of the door when the latch is in the engaged position, the linear actuator coupled to the latch at the second end portion of the latch.

14. The vertical axis washing machine appliance of claim 13, the lever arm defines a recess at the distal end portion of the lever arm, the first end portion of the latch received within the recess of the lever arm when the latch is in the engaged position, the first end portion of the latch removed from the recess of the lever arm when the latch is in the disengaged position.

15. The vertical axis washing machine appliance of claim 11, wherein the actuator is an electromechanical solenoid.

16. The vertical axis washing machine appliance of claim 15, wherein the latch is a shaft coupled to the electromechanical solenoid, the electromechanical solenoid operable to extend and retract the shaft along the lateral direction.

17. The vertical axis washing machine appliance of claim 16, the lever arm defines a recess at the distal end portion of the lever arm, the shaft received within the recess of the lever arm when the latch is in the engaged position, the shaft removed from the recess of the lever arm when the latch is in the disengaged position.

18. The vertical axis washing machine appliance of claim 11, further comprising a biasing mechanism coupled to the lever arm and the cabinet, the biasing mechanism applying a force to the lever arm that urges the door towards an open position.

19. The vertical axis washing machine appliance of claim 18, wherein the biasing mechanism is a coil spring or a gas spring.

* * * * *